United States Patent [19]

Creissels

[11] Patent Number: 4,953,468

[45] Date of Patent: Sep. 4, 1990

[54] LARGE SPAN GONDOLA LIFT

[75] Inventor: Denis Creissels, Meylan, France

[73] Assignee: Pomagalski S.A., France

[21] Appl. No.: 821,527

[22] Filed: Jan. 24, 1986

Related U.S. Application Data

[63] Continuation of Ser. No. 587,639, Mar. 8, 1984, abandoned.

[30] Foreign Application Priority Data

Mar. 21, 1983 [FR] France ..... 83 04707

[51] Int. Cl.[5] ..... E01B 25/00

[52] U.S. Cl. ..... 104/123; 104/125

[58] Field of Search ..... 104/123–126, 104/173 R, 173 S, 173 T; 212/76, 218; 52/40, 155, 296; 174/45 R, 43; 14/21

[56] References Cited

U.S. PATENT DOCUMENTS

| | | | |
|---|---|---|---|
| 685,346 | 10/1901 | Riblet | 104/123 |
| 2,266,522 | 12/1941 | Vogel | 104/125 |
| 2,378,081 | 6/1945 | Holman | 14/21 X |
| 3,839,967 | 10/1974 | Wyssen | 104/173 R |
| 4,353,527 | 10/1982 | Langford | 212/76 X |

FOREIGN PATENT DOCUMENTS

| | | | |
|---|---|---|---|
| 119905 | 3/1983 | European Pat. Off. | 104/123 |
| 338583 | 12/1903 | France . | |
| 1183070 | 7/1959 | France . | |

*Primary Examiner*—Johnny D. Cherry
*Assistant Examiner*—Joseph D. Pape
*Attorney, Agent, or Firm*—Arnold, White & Durkee

[57] ABSTRACT

The towers (12, 14) of an aerial cable (16) transport installation lean towards one another to reduce their height. Guying cables (48) hold the towers (12, 14).

5 Claims, 4 Drawing Sheets

Fig- 4
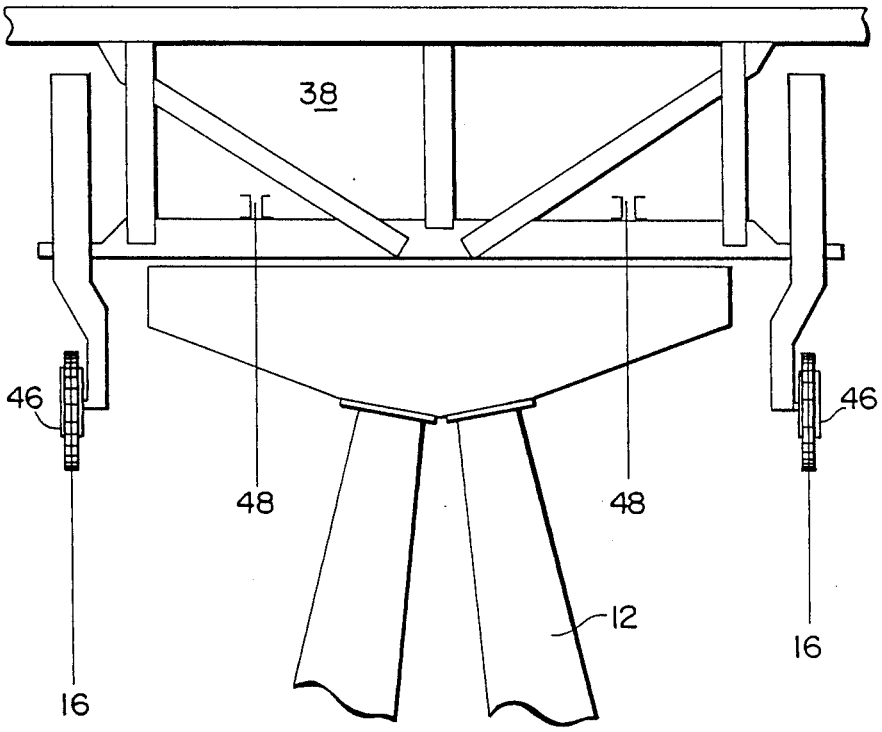
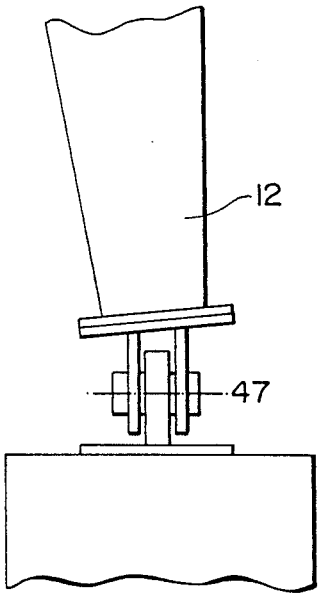
Fig- 5

LARGE SPAN GONDOLA LIFT

This is a continuation of application Ser. No. 587,639 filed Mar. 8, 1984, now abandoned.

BACKGROUND OF THE INVENTION

The invention relates to an aerial cable transport installation, in particular a gondola-lift or a cable-car, having a large span between two towers located far apart, the base of each tower being anchored to the ground and the head constituting a support point for the taut cable, following a predetermined catenary trajectory under the action of a tension device, between the two towers.

The towers of known installations of the kind mentioned are vertical or even, in the case of sloping ground, perpendicular to the ground, their height being of course sufficient to clear obstacles along the line. The present invention results from the ascertainment that when large spans, and therefore large cable sag, are involved, the height of the towers increases very quickly with the increase in the distance the towers are apart and become excessive. The location of the towers is frequently imposed by the site and in particular to cross a river the towers anchored on the banks are of a considerable height.

SUMMARY OF THE INVENTION

The first aim of the present invention is to enable the height of the towers to be reduced and this objective is achieved, according to the present invention, by having the towers lean towards one another to reduce the cable span, the distance between the cable support points on the towers being smaller than the distance between the tower anchoring points on the ground.

The towers are advantageously set perpendicular to the cable trajectory at the support point, this lay-out corresponding to a maximum reduction in their height. The tower anchoring point and the catenary trajectory of the cable are fixed by the characteristics of the installation: all that has to be done is to draw the perpendicular to this trajectory passing through the anchoring point to fix the optimal gradient of the tower. The foot of the tower is advantageously articulated and guys, in particular cables stretched to the rear, hold the tower in the inclined position. The weight of the tower can be sufficient to keep the guy(s) taut, but according to a perfection of the invention, the heads of the two towers are connected by a pretaut cable, which simultaneously carries out other functions, in particular data transfer or even electric power link.

Another aim of the invention is to orientate obliquely the thrust the tower exerts on the ground, thus enabling, when crossing a river, a pressure towards the inside to be maintained on the banks.

According to a development of the invention, the guying cable constitutes the carrier cable for an auxiliary cable-car giving access to the tower head, where a panoramic or maintenance platform is installed.

The installation can be a single or double-track cable-car or a mono-cable or bi-cable gondola-lift with cars spaced along the cable or grouped together in a train and the line can be limited to the section between the two inclined towers or be joined to other conventional sections.

BRIEF DESCRIPTION OF THE DRAWINGS

Other advantages and characteristics will become more clearly apparent from the description which follows of a mode of implementation of the invention, given as a non-limiting example and represented in the attached drawings, in which:

FIGS. 4 to 6 are detailed views of the tower according to FIG. 3;

DESCRIPTION OF THE PREFERRED EMBODIMENT

Figure 1:
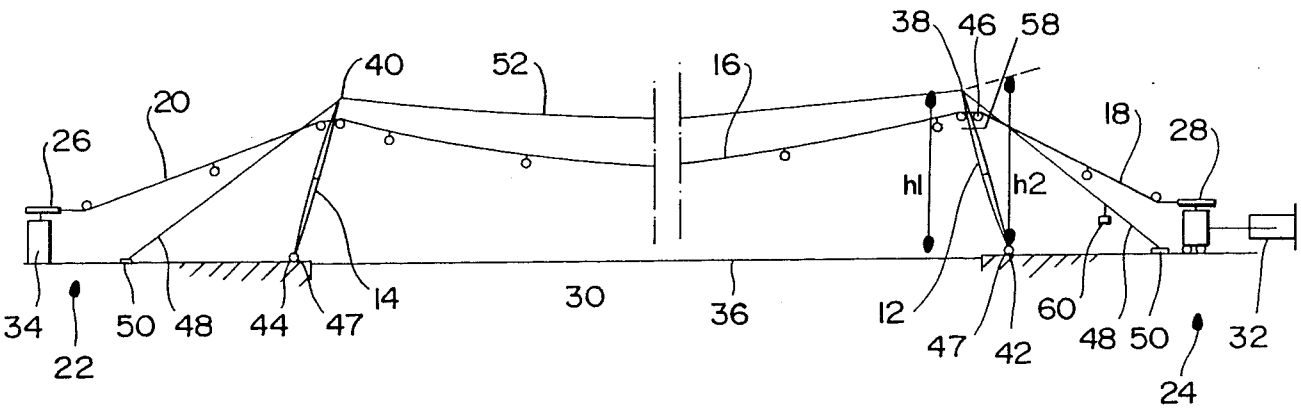
FIG. 1 is a schematic side elevation of an installation according to the invention.
Figure 2:
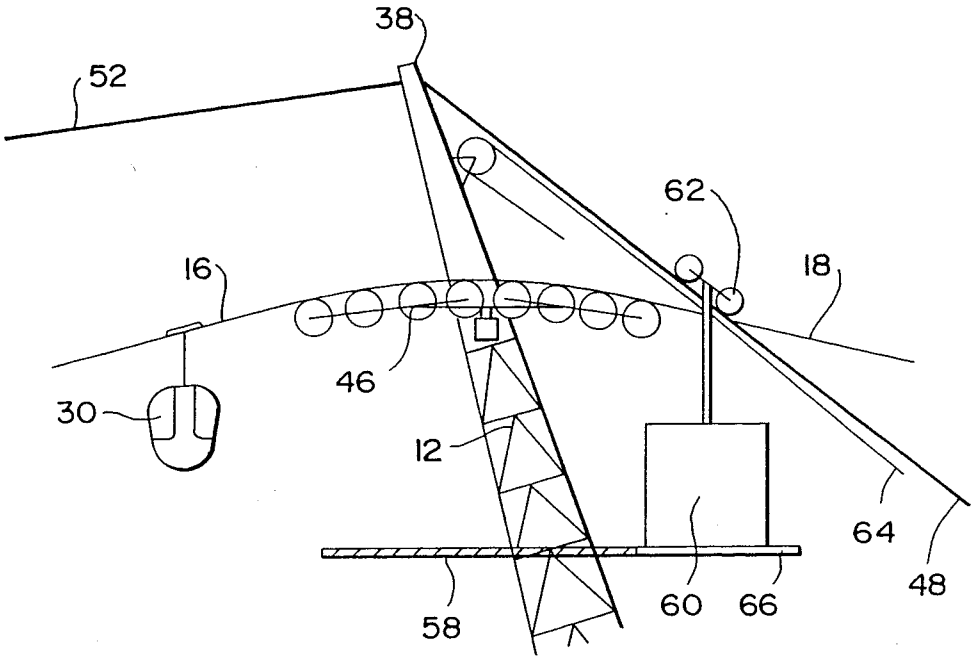
FIG. 2 is a partial view on an enlarged scale of the head of the tower according to FIG. 1.

In the figures, a mono-cable gondola-lift presents a large-span section 10, delimited by two support towers 12, 14. A carrier-hauling cable 16 is stretched between the two towers 12, 14 and is extended on both sides by access sections 18, 20, which end in terminals 22, 24, each one equipped with a cable return wheel 26, 28, said cable forming a closed car, endless circulation loop. Cable 16 is maintained under tension by a jack 32 which thrusts against wheel 28, and the cable is driven by a motor 34 coupled to wheel 26.

Gondola-lifts of this kind are well-known and can be of the pulsed type wherein the cable is stopped or slowed down for loading and unloading of passengers, or of the continuous type wherein the cars are detached from the cable in continuous travel through the terminals 22, 24. It is clear that the invention can be applied to a bi-cable gondola-lift comprising a separate carrier cable and hauling cable, the carrier cable being anchored in the terminals, as well as to a shuttle or two-way cable-car. For example, such installations are described in U.S. Pat. Nos. 4,050,385; 3,405,652; 4,003,314; and 3,827,368.

The gondola-lift, shown in the figures, crosses for instance a river 36, the feet 42, 44 of towers 12, 14 being anchored on the two banks. Towers 12, 14 lean towards each other, the distance between their heads 38, 40 being smaller than that between their feet 42, 44. The heads 38, 40 support the sheave batteries 46 supporting cable 16, which follows a catenary trajectory determined by the load. Each tower foot 42, 44 is articulated on an axis 47 perpendicular to the vertical plane containing cable 16, and one or more guys 48, in particular guying cables are fixed at one end to tower 12, 14 head and at the other end to an anchoring point 50 away from the bank. Guys 48 keep tower 12, 14 in the inclined position in opposition to the weight and the bearing force of cable 52, which ensures pretension and, if required, an electric power or safety link between the two towers 12, 14.

Referring to FIG. 1, it can be seen that for a given catenary trajectory of cable 16, the height $h_1$ of towers 12, 14, inclined according to the invention, is smaller than the height $h_2$ of the towers set vertically. The gradient is chosen so that the direction of tower 12, 14 is appreciably perpendicular to cable 16 at the latter's support point 46, which corresponds to a minimum tower height.

Figure 3:
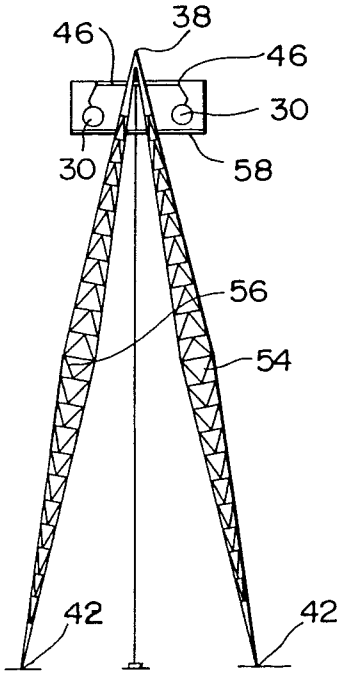
FIG. 3 is a side view of a tower.
Figure 7:
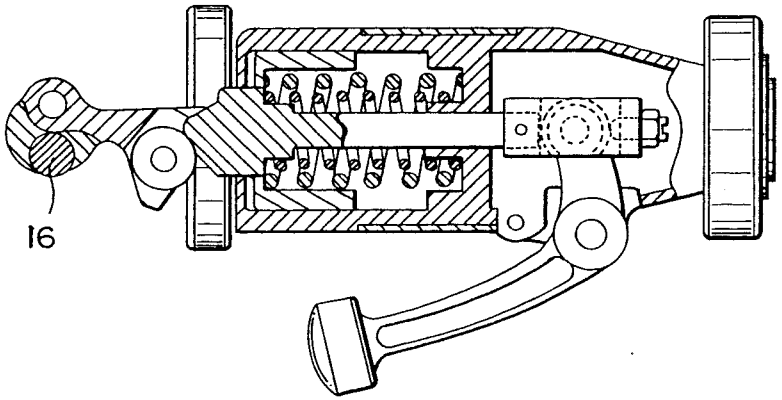
FIG. 7 is a cross-section of a coupling grip.
Figure 6:
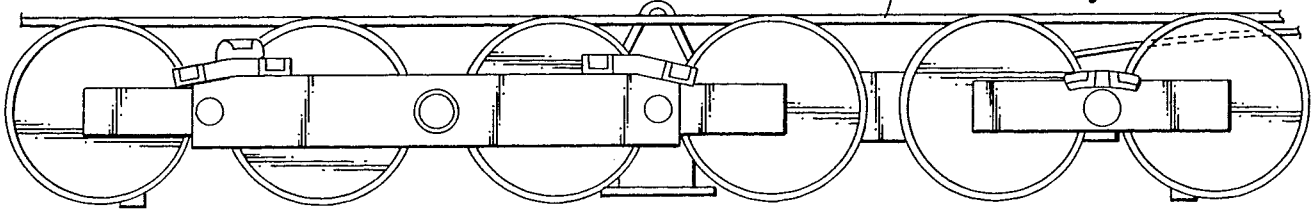

Each tower 12, 14 has two inverted V-shaped legs 54, 56 which join at the top 38, as shown in FIG. 3, each leg being elongated diamond-shaped to ensure the best possible resistance to buckling stresses. Any other structure can of course be used.

A platform 58 is fixed to the head of tower 12, the platform 58 being sufficiently low not to hinder the passage of the cars 30. This platform 58 facilitates sheave battery 46 maintenance and constitutes a panoramic platform. Access to platform 58 is facilitated by an auxiliary cable-car having a truck 60 the carriage 62 of which runs on the guying cable 48 being pulled by a hauling cable 64. An opening 66 or an orifice provided in platform 58, enables the truck 60 to pass through, the latter stopping at the level of the platform to load and unload passengers. The system is simple and uses standard installations the constitution and operation of which will not be described in more detail. Tower 14 can be equipped in a similar fashion with an auxiliary cable-car of this kind.

The lean of towers 12, 14, according to the invention, also has the advantage of exerting on the banks a thrust towards the inside of the land enabling anchoring points 42, 44 to be brought as close together as possible without the risk of the bank collapsing and thus limiting the span between the two towers 12, 14.

We claim:

1. An aerial cable transport installation for a gondola-lift or a cablecar having a large span, said installation comprising:

two towers located apart by a large spaced distance, each tower having a base anchored to the ground and a head forming a support point, a carrier cable stretched between the two towers, said carrier cable being slidably supported on the tower heads and following a predetermined catenary trajectory, at least one car carried by the carrier cable to travel on said trajectory, a tower guying cable for each tower, each tower guying cable extending from an anchoring point adjacent the tower base to the tower head, and said towers being inclined and arranged to lean only towards one another to reduce the span of the carrier cable between the two towers and reduce a vertical height component of the towers required to span an identical horizontal distance between the bases of the towers, the distance between the carrier cable support points on the inclined towers being smaller than the distance between the bases anchored to the ground, each tower gradient being substantially perpendicular to said caternary trajectory of the carrier cable between the two towers at a point adjacent to that tower to minimize the tower height, each tower guying cable extending in a direction opposite a leaning direction of the corresponding tower.

2. The installation according to claim 1, wherein the structure of each tower includes two legs joined at the head of the tower to form an inverted V-shaped tower, each leg having a base anchored to the ground.

3. The installation according to claim 1, wherein the tower guying cable constitutes an auxiliary carrier cable for an auxiliary cable-car to gain access to the head of the tower equipped with a platform.

4. The installation according to claim 1, wherein the two towers are anchored on the two banks on opposite sides of a river and lean over the river, the towers being retained by the tower guying cables anchored to the banks at positions located in a direction opposite to the leaning direction of the corresponding tower, the carrier cable stretched between the two towers being extended on both sides by inclined access sections ending at terminals on both banks.

5. The installation according to claim 4, wherein the carrier cable and its inclined access sections form an endless cable stretching between the two terminals and following a closed loop trajectory, said carrier cable being driven to constitute a carrier-hauling cable for cars spaced along the cable.

* * * * *